US008265541B2

(12) United States Patent
Kougami

(10) Patent No.: US 8,265,541 B2
(45) Date of Patent: Sep. 11, 2012

(54) SHEET PROCESSING APPARATUS AND IMAGE FORMING SYSTEM WHICH CORRECTS A CURL

(75) Inventor: Masashi Kougami, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 579 days.

(21) Appl. No.: 12/482,803

(22) Filed: Jun. 11, 2009

(65) Prior Publication Data

US 2009/0317160 A1 Dec. 24, 2009

(30) Foreign Application Priority Data

Jun. 18, 2008 (JP) ..... 2008-158901

(51) Int. Cl.
*G03G 15/00* (2006.01)
*B65H 29/70* (2006.01)
*B65H 31/00* (2006.01)

(52) U.S. Cl. ..... 399/406; 271/188; 271/209

(58) Field of Classification Search ..... 399/406; 271/188, 209

See application file for complete search history.

(56) References Cited

U.S. PATENT DOCUMENTS 5,848,347 A * 12/1998 Kuo et al. ..... 399/406
7,471,925 B2 12/2008 Shida et al.
2005/0084307 A1* 4/2005 Muratani ..... 399/406
2007/0240640 A1* 10/2007 Shida et al. ..... 118/258
2007/0280765 A1* 12/2007 Shida et al. ..... 399/406

FOREIGN PATENT DOCUMENTS

JP 58-100056 A 6/1983
JP 4-338060 A 11/1992
JP 5-309971 A 11/1993
JP 2007-279551 A 10/2007
JP 2007-284157 A 11/2007
JP 2007292914 * 11/2007
JP 2008303046 * 12/2008

OTHER PUBLICATIONS

Japanese Office Action dated May 22, 2012 (and English translation thereof) in counterpart Japanese Application No. 2008-158901.

* cited by examiner

*Primary Examiner* — Judy Nguyen
*Assistant Examiner* — Blake A Tankersley
(74) *Attorney, Agent, or Firm* — Holtz, Holtz, Goodman & Chick, PC

(57) ABSTRACT

A sheet processing apparatus including: a humidifier that humidifies a sheet; a curl correcting section that corrects a curl by applying mechanical bending force on a sheet; and a control section that causes humidification by the humidifier and curl correction by the curl correcting section to be possible for a prescribed sheet, and causes either one of humidification by the humidifier and curl correction by the curl correcting section to be possible for sheets other than the prescribed sheet.

19 Claims, 10 Drawing Sheets

SHEET PROCESSING APPARATUS AND IMAGE FORMING SYSTEM WHICH CORRECTS A CURL

RELATED APPLICATION

This application is based on Japanese Patent Application No. 2008-158901 filed with Japanese Patent Office on Jun. 18, 2008, the entire content of which is hereby incorporated by reference.

BACKGROUND

1. Field of the Invention

The present invention relates to a sheet processing apparatus that corrects a curl of a sheet and to an image forming system equipped with the sheet processing apparatus.

2. Description of Related Art

Image forming by an electrophotographic process is one for forming an image through a process wherein a toner image is formed by charging, light exposure and developing, then, the toner image thus formed is transferred onto a sheet, and the toner image thus transferred onto the sheet is fixed, as is known widely.

In a fixing step in this process, toner is fused by heat and pressure so that an image is fixed on a sheet, and in this occasion, there is presented a phenomenon that moisture is vaporized by heat from the sheet.

There is further presented a phenomenon that a sheet absorbs moisture from the open air when the sheet is exposed to the open air.

Since a rate of occurrence of these evaporation, absorption and radiation of moisture on a surface of the sheet is different from that on the other side of the sheet, there is a problem that waviness and curls are caused on the sheet.

Sheets having waviness and curl cause troubles for conveyance, processing and stacking in a sheet processing apparatus that is connected to an image forming apparatus, and they become obstacles for processing and storage for sheets such as an increase in a volume of sheets bundled by binding processing, thus, a technology to correct sheet curls has been developed.

Namely, Unexamined Japanese Patent Application Publication No. 4-338060 and Unexamined Japanese Patent Application Publication No. 5-309971 disclose a technology to correct curls by applying mechanical bending force for a sheet on a sheet conveyance path, and Patent Document 2 discloses a technology to select an air volume of a fan in accordance with a sheet type and image density and to radiate moisture of a sheet.

Though an extent of curl correction can be selected in accordance with a sheet type in the structure described in Unexamined Japanese Patent Application Publication No. 4-338060, it has been found that curls cannot be corrected sometimes by adjustment of mechanical bending force alone even if bending force is adjusted, because sheets are of various types.

For example, it has been found that curls can be corrected by applying strong force in the case of a thick sheet, but, in the case of a thin sheet, it is difficult to correct curls by mechanical bending force alone, and it is difficult to correct curls by bending force alone in the case of fine-quality sheets for printing.

It has been further found that curls cannot be corrected by radiating moisture of a sheet alone, in a similar manner, in the structure described in Unexamined Japanese Patent Application Publication No. 5-309971.

SUMMARY

One aspect of the present invention is as follows.

Item 1. A sheet processing apparatus comprising: a humidifier that humidifies a sheet; a curl correcting section that corrects a curl by applying mechanical bending force on the sheet; and a control section that causes humidification by the humidifier section and curl correction by the curl correcting section to be possible for a prescribed sheet, and causes either one of humidification by the humidifier and curl correction by the curl correcting section to be possible for sheets other than the prescribed sheet.

Item 2. An image forming system comprising an image forming apparatus to form an image on a sheet, the sheet processing apparatus described in the Item 1, and a post-processing apparatus for post-processing the sheet.

DETAILED DESCRIPTION OF THE PREFERRED EMBODIMENTS

Figure 1:
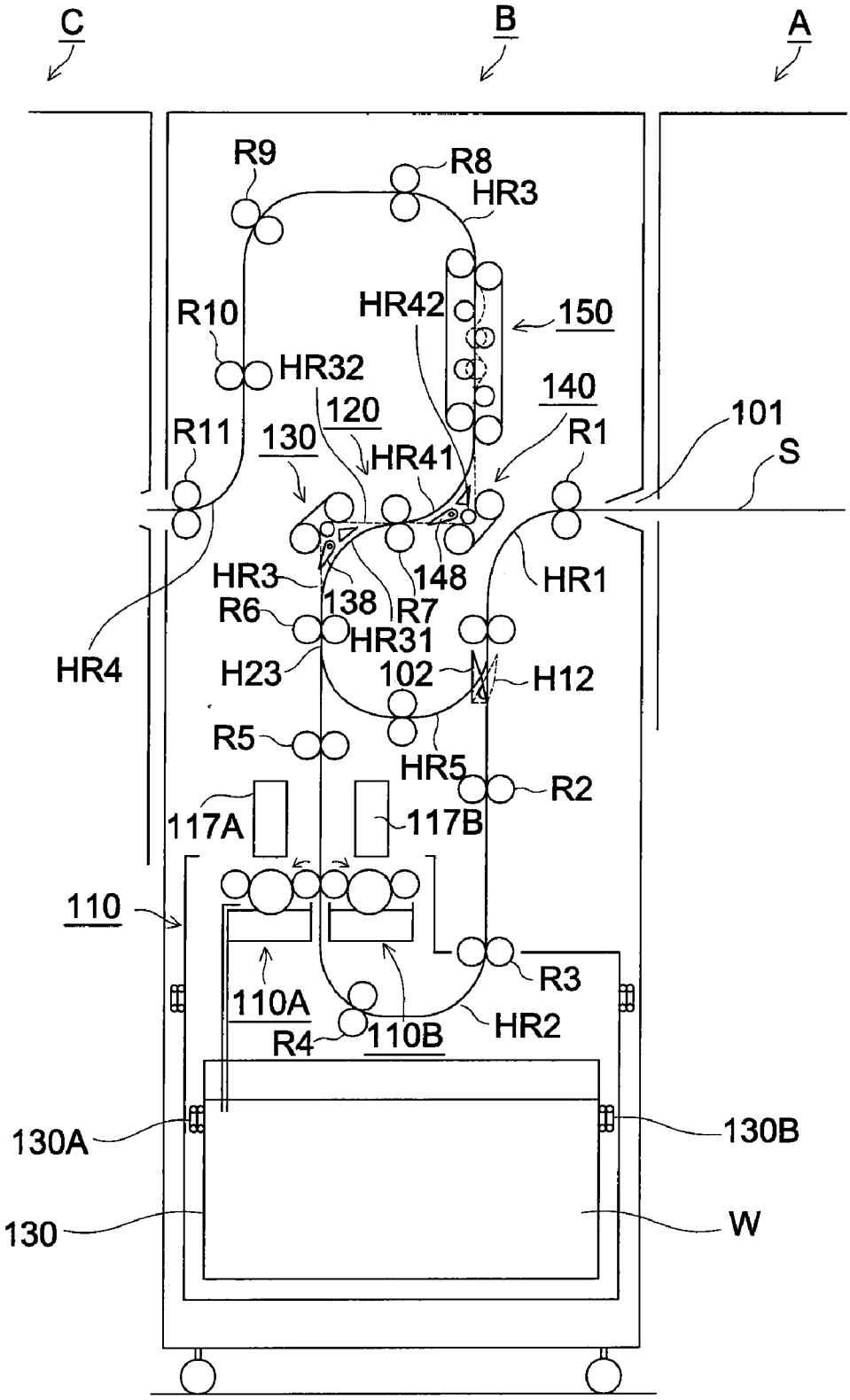
FIG. 1 is a sectional view of a sheet processing apparatus.

An example of the embodiment relating to the present invention will be explained as follows, referring to the drawings, in which the scope of the invention is not limited by the terminologies used in the specifications.

In the following explanation, a wording of the width direction means the direction perpendicular to the direction in which the sheets are conveyed.

Further, the upper reaches means the side from which a sheet is conveyed in the sheet conveyance direction, while, the lower reaches means the side toward which a sheet is conveyed.

Further, the upward curl means a curl that is convex on a certain surface side of a sheet conveyed in a sheet processing apparatus, while, the downward curl means a curl that is convex on the side that is opposite to the upward curl, namely, the curl that is convex on the side opposite to the certain surface of the sheet to be conveyed.

In the structure described later, an upward curl means a curl that is convex on the side of an image forming surface, for example, and a downward curl means a curl that is concave, for example, on the side of an image forming surface.

Further, the curl correction for correcting a curl by applying mechanical bending force on a sheet is also described as a curl adjustment.

FIG. 1 is a sectional view of a sheet processing apparatus.

Sheet processing apparatus B has therein entrance conveyance path HR1 representing an entrance conveyance path through which a sheet is conveyed, humidification conveyance path HR2 representing a humidification conveyance path on which humidifying section 110 (humidifier) is arranged, correction conveyance path HR3 representing a curl correcting conveyance path having thereon curl correcting section 120 (including curl correcting section 130, curl correcting section 140 and curl correcting section 150), exit conveyance path HR4 representing an exit conveyance path through which a sheet is ejected to a post-process and bypass conveyance path HR5 for bypassing the humidification conveyance path HR2 (humidifying section).

Sheet S on which an image has been formed in image forming apparatus A (which will be explained later) is fed to entrance 101 of sheet processing apparatus B to be introduced to the entrance conveyance path HR1.

Then, humidifying processing is carried out in the humidifying section 110 of the humidification conveyance path HR2 for the sheet S which undergoes curl correction processing at the curl correcting section 130, the curl correcting section 140 or the curl correcting section 150 on the correction conveyance path HR3, to be ejected from the exit conveyance path HR4.

Further, in case of need, the bypass conveyance path HR5 that bypasses off switching section H12 between the entrance conveyance path HR1 and the humidification conveyance path HR2, and joins at switching section H23 between the humidification conveyance path HR2 and the correction conveyance path HR3, which makes it possible to bypass the humidifying section 110.

In the entrance conveyance path HR1, the sheet S is conveyed by roller R1, and in the humidification conveyance path HR2, the sheet S is conveyed by rollers R2-R5.

Further, in the correction conveyance path HR3, the sheet S is conveyed by rollers R6-R10, while, in the exit conveyance path HR4, the sheet S is conveyed by rollers R11.

Incidentally, the following explanation will be given under the assumption that the surface of the sheet S on which an image has been formed faces upward in the illustration at entrance 101.

The sheet processing apparatus B is capable of practicing a mode without processing that conducts no processing by sheet processing apparatus B, a humidifying mode that conducts only humidifying processing, a first curl correction mode that conducts only curl correction and a second curl correction mode that conducts humidification and curl correction.

In the mode without processing, the bypass conveyance path HRS which will be explained later is selected by switching gate 102, and correction conveyance paths HR31 and HR41 which will be explained later are selected respectively by switching gate 138 and switching gate 148.

Owing to the foregoing, the sheet S advances to the bypass conveyance path HR5 from the entrance conveyance path HR1, and passes through correction conveyance path HR31, correction conveyance path HR41, correction conveyance path HR3 and exit conveyance path HR4 to be ejected without being processed.

In the humidifying mode, humidification conveyance path HR2 which will be explained later is selected by switching gate 102, and correction conveyance paths HR31 and HR41 are selected respectively by switching gates 138 and 148.

Owing to this, the sheet S advances to the humidification conveyance path HR2 from the entrance conveyance path HR1, and passes through correction conveyance path HR31, correction conveyance path HR41, correction conveyance path HR3 explained later and exit conveyance path HR4, after being processed in terms of humidification in the humidifying section 110, to be ejected.

A mode to carry out curl correction includes a mode to conduct upward curl correction, a mode to conduct downward curl correction and a mode to correct both upward curl and downward curl.

In the mode for conducting correction for upward curls, humidification conveyance path HR2 or bypass conveyance path HR5 is selected by switching gate 102, correction conveyance path HR32 explained later is selected by switching gate 138 and correction conveyance path HR41 is selected by switching gate 148.

Owing to this, the sheet S advances to the humidification conveyance path HR2 or to the bypass conveyance path HR5 from the entrance conveyance path HR1, and passes through correction conveyance path HR41, correction conveyance path HR3, and exit conveyance path HR4, after being corrected in terms of upward curls by the curl correcting section 130, to be ejected.

In the mode for conducting correction for downward curls, humidification conveyance path HR2 or bypass conveyance path HR5 is selected by switching gate 102, correction conveyance path HR31 is selected by switching gate 138 and correction conveyance path HR42 is selected by switching gate 148.

Owing to this, the sheet S advances to the correction conveyance path HR42 from the entrance conveyance path HR1, by passing through the humidification conveyance path HR2 or bypass conveyance path HR51 and bypass conveyance path HR31, and passes through correction conveyance path HR3 and exit conveyance path HR4 after being corrected by curl correcting section 140 in terms of downward curls, to be ejected.

In the mode to correct both upward and downward curls, the humidification conveyance path HR2 or bypass conveyance path HR5 is selected by switching gate 102, correction conveyance path HR31 which will be explained later is selected by switching gate 138, correction conveyance path HR41 is selected by switching gate 148, and curl correcting section 150 is caused to operate.

Owing to the foregoing, the sheet S advances to the correction conveyance path HR3 from the entrance conveyance path HR1, by passing through the humidification conveyance path HR2 or bypass conveyance path HRS, bypass conveyance path HR31 and bypass conveyance path HR41, and passes through correction conveyance path HR3 and exit conveyance path HR4 after being corrected by curl correcting section 150 explained later in terms of upward and downward curls, to be ejected.

Meanwhile, the mode to correct both upward and downward curls may also be of the structure wherein upward curls and downward curls are corrected by the curl correcting section 130 and the curl correcting section 140.

The second curl correction mode that conducts humidification and curl correction includes a mode to conduct corrections for upward curls and a mode to conduct corrections for downward curls.

In the mode conducting corrections for upward curls, humidification conveyance path HR2 is selected by switching gate 102, correction conveyance path HR32 is selected by switching gate 138, and correction conveyance path HR41 is selected by switching gate 148.

Owing to this, the sheet S advances to the humidification conveyance path HR2 from the entrance conveyance path HR1, and is corrected in terms of upward curls by curl correcting section 130 after being processed in terms of humidification by humidifying section 110, and then, it passes through correction conveyance path HR3 and exit conveyance path HR4, to be ejected.

In the mode conducting corrections for downward curls, humidification conveyance path HR2 is selected by switching gate 102, correction conveyance path HR31 is selected by switching gate 138, and correction conveyance path HR42 is selected by switching gate 148.

Owing to this, the sheet S advances to the humidification conveyance path HR2 from the entrance conveyance path HR1, and is corrected in terms of downward curls by curl correcting section 140 after being processed in terms of humidification by humidifying section 110, and then, it passes through correction conveyance path HR3 and exit conveyance path HR4, to be ejected.

Incidentally, as stated above, switching gate 102 switches between sheet conveyance paths (the first conveyance path extending from entrance conveyance path HR1 toward humidification conveyance path HR2, and the second conveyance path extending from entrance conveyance path HR1 toward bypass conveyance path HR5).

On the humidification conveyance path HR2, there is arranged humidifying section 110 that humidifies sheet S.

The humidifying section 110 is formed as a unit which can be drawn out of an apparatus through a guide by a guide rail.

On the lower portion of the humidifying section 110, there is arranged tank 130 that supplies water to the humidifying section 110, and the tank 130 is capable to be drawn out of an apparatus through a guide by guide rails 130A and 130B.

In correction conveyance path HR3, there is arranged curl correcting section 120 correcting curls of sheets wherein there are arranged curl correcting section 130 for correcting upward curls representing the first curl correcting section that corrects curls by applying mechanical bending force from the first surface side of a sheet, curl correcting section 140 for correcting downward curls representing the second curl correcting section that corrects curls by applying mechanical bending force from the first surface side and from the second surface side on the opposite side and curl correcting section 150 for correcting upward and downward curls representing the third curl correcting section that corrects curls by applying mechanical bending forces from the first surface side and from the second surface side of the sheet alternately.

Thus, upward curls are corrected to be flat by operations of the curl correcting section 130, downward curls are corrected to be flat by operations of the curl correcting section 140 and both upward and downward curls are corrected to be flat by operations of the curl correcting section 150.

The humidifying section 110 and the curl correcting section 120 will be explained in detail as follows.

Figure 2:
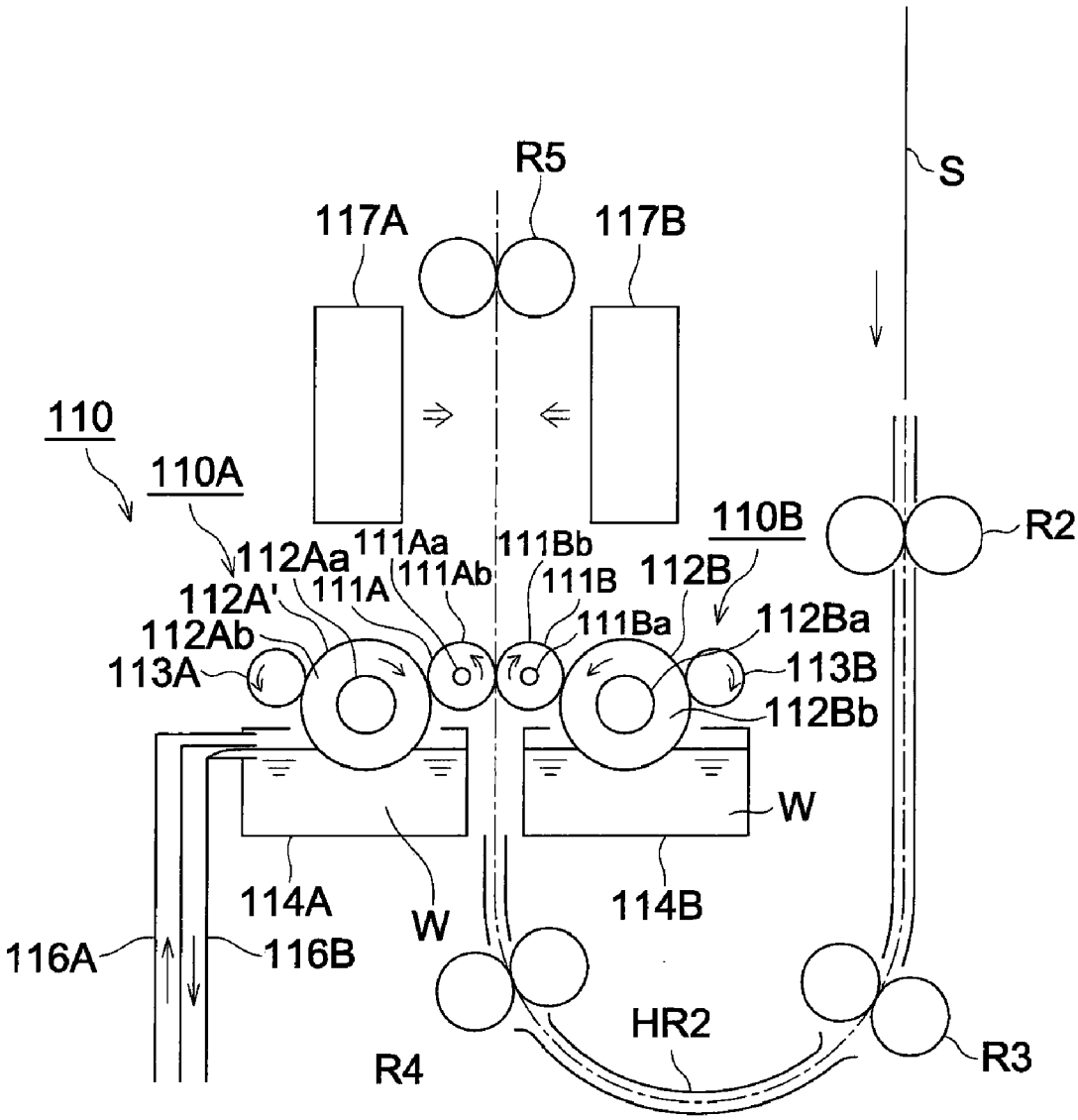
FIG. 2 is an enlarged diagram of humidifying section 110 (humidifier).

FIG. 2 is an enlarged diagram of humidifying section 110.

Humidification conveyance path HR2 is formed to be U-shaped, and sheet S advances downward almost vertically from entrance conveyance path HR1 (not shown), then, it makes a U-turn to advance upward vertically, and humidifying section 110 is arranged at the portion that is an upper part of the humidification conveyance path HR2 to which the sheet S advances.

The humidifying section 110 has a pair of humidifying sections arranged respectively to face the humidification conveyance path HR2, namely, has humidifying section 110A on the left side in the drawing and humidifying section 110B on the right side, and the humidifying section 110A has humidifying roller 111A, water-supply roller 112A and water-supply tank 114A, while, the humidifying section 110B has humidifying roller 111B, water-supply roller 112B and water-supply tank 114B.

The water-supply roller 112A is in contact with the humidifying roller 111A, and the water-supply roller 112B is in contact with the humidifying roller 111B, while, the water-supply roller 112A is soaked in water W contained in the water-supply tank 114A, and the water-supply roller 112B is soaked in water W contained in the water-supply tank 114B.

Further, the humidifying roller 111A and the humidifying roller 111B which face each other are in contact with each other, and they rotate in the directions of their own arrows to humidify sheet S by giving water while conveying the sheet S.

Each of 113A and 113B represents a water-adjusting member, and the water-supply roller 112A is squeezed by the water-adjusting member 113A and the water-supply roller 112B is squeezed by the water-adjusting member 113B, so that water content of each of the water-supply roller 112A and the water-supply roller 112B may be regulated.

For the humidifying rollers 111A and 111B and for the water-supply rollers 112A and 112B, there are used single-layer structured or multiple-layer structured rollers made of elastic materials such as solid rubber that is not foaming and foaming rubber or multiple-layer structured rollers each being of the structure in which fibers are wound around rubber.

The humidifying roller 111A is composed of shaft core 111Aa made of metal and of rubber layer 111Ab formed on the shaft core 111Aa, and the humidifying roller 111B is composed of shaft core 111Ba made of metal and of rubber layer 111Bb formed on the shaft core 111Ba.

The water-supply roller 112A is composed of shaft core 112Aa made of metal and of rubber layer 112Ab formed on the shaft core 112Aa, and the water-supply roller 112B is composed of shaft core 112Ba made of metal and of rubber layer 112Bb formed on the shaft core 112Ba.

For the water-adjusting members 113A and 113B, there is used a rotating (that rotates in the direction of an arrow when it rotates) or fixed round bar. It is further possible to use a tabular blade, as the water-adjusting members 113A and 113B.

Water W in tank 130 is drawn up by a pump (not shown) into water-supply tanks 114A and 114B through feed water pipe 116A, and it flows back from overflow pipe 116B to the tank 130 through overflowing, whereby, water levels respectively in the water-supply tanks 114A and 114B are maintained to be constant.

Meanwhile, the water-supply tank 114A is communicated with the water-supply tank 114B, and water levels in both of them are kept to be constant.

In the humidifying processing, the humidifying rollers 111A and 111B and water-supply rollers 112A and 112B are rotated in the directions shown by their own arrows, to conduct humidifying processing by giving water to both sides of sheet S.

Since both the humidifying rollers 111A and 111B are arranged to be bilaterally symmetric about humidification conveyance path HR2 as illustrated, and both the water-supply rollers 112A and 112B are arranged to be bilaterally symmetric about humidification conveyance path HR2 as illustrated, a water-supply channel covering from water-supply tank 114A to humidifying roller 111A and a water-supply channel covering from water-supply tank 114B to humidifying roller 111B are the same in terms of a shape and a length.

Therefore, equal supplies of water are conducted to sheet S from its both sides. In addition, an equal amount of water in the direction of a thickness of sheet S is supplied to sheet S, and flatness of sheet S is kept favorably, because the sheet S is humidified in humidification conveyance path HR2 that goes up vertically.

The symbols 117A and 117B represent fans that blow a dried wind against both sides of sheet S, and blowing a dried wind against sheet S by fans 117A and 117B causes excessive water to evaporate from sheet S that is immediately after humidification, and prevents that water is accumulated on an conveyance path forming member such as a conveyance roller.

Figure 3:
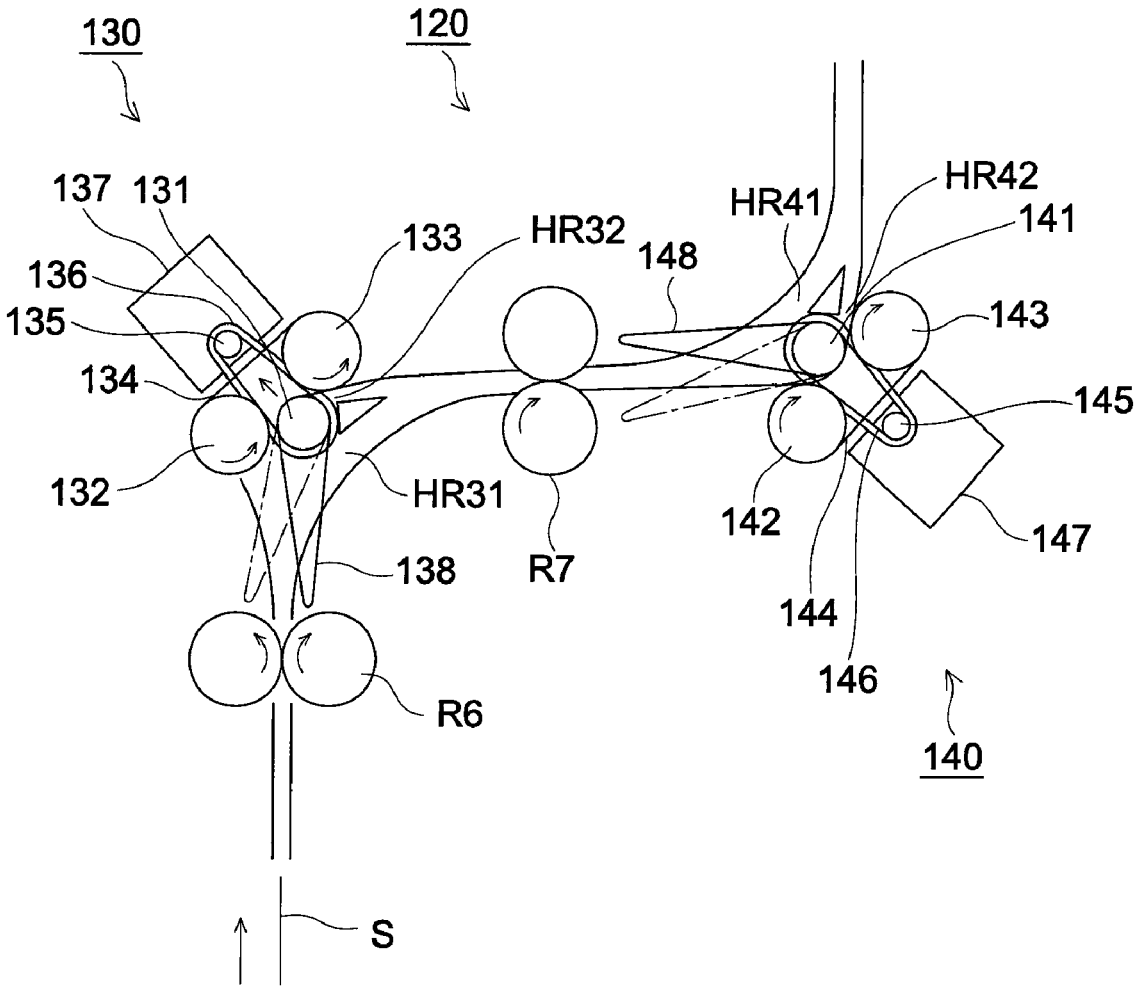
FIG. 3 is an enlarged illustration of a curl correcting section.

FIG. 3 is an enlarged illustration of a curl correcting section.

Curl correcting section 120 correcting curls by applying mechanical bending force on a sheet is one that applies mechanical force (bending force) in the direction from a convex portion to a concave portion (in the direction opposite to curls) and corrects curls by the bending force to correct curls.

The curl correcting section 120 has therein curl correcting section 130 that corrects the upward curls, curl correcting section 140 that corrects downward curls and curl correcting section 150 (FIG. 4) mentioned later which corrects both upward and downward curls.

The curl correcting section 130 has therein small-diameter roller (for example, radius of 7 mm) 131, a pair of belt-drive rollers 132 and 133, belt 134 trained about the belt-drive rollers 132 and 133, spring hooking shaft 135, pressure spring 136 that presses belt 134 through the small-diameter roller 131 in the direction (arrow) opposite to the conveyance path for a sheet, and first correction extent adjusting section 137 that urges the spring hooking shaft 135 in the direction (arrow) opposite to that of a conveyance path for a sheet to change stress of the pressure spring 136 and adjusts an extent of curl correction for a sheet.

In the curl correcting section 130, when switching gate 138 that switches conveyance paths is at the position shown by one-dot chain lines, correction conveyance path HR31 that does not pass through the curl correcting section 130 is selected, while, when the switching gate 138 is at the position shown by solid lines, correction conveyance path HR32 that passes through the curl correcting section 130 is selected.

Further, the switching gate 138 is turned on or turned off by a control section which will be explained later, depending on a thickness and a type of a sheet and on the direction of a curl.

Since the correction conveyance path HR31 has a large radius of curvature (for example, radius 60 mm) as is illustrated, curls are not corrected when sheet S conveyed in the direction of an arrow passes through the correction conveyance path HR31.

In contrast to this, when sheet S passes through correction conveyance path HR32 formed by small-diameter roller 131 and by belt 134, bending force by the small-diameter roller 131 and by the belt 134 is applied on the sheet S, and curls on the sheet S are corrected.

Sheet S having thereon an image formed on the upper surface in entrance 101 and having upward curls (namely, upward convex form in entrance 101) is in a posture wherein its image surface faces downward obliquely on the right side, in the curl correcting section 130 (namely, convex form facing downward obliquely on the right side).

Therefore, the sheet having upward curls, namely, having a convex form facing downward obliquely on the right side receives urging force in the direction opposite to the direction of the convex form by small-diameter roller 131 (namely, bending force caused by small-diameter roller 131 and by belt 134), when the sheet passes through correction conveyance path HR32 along the belt 134.

As a result, upward curls are corrected to be in a shape of a flat plate.

Further, this urging force can be adjusted by the first correction extent adjusting section 137, and is changed by a control section explained later, depending on a thickness and a type of a sheet.

The curl correcting section 140 has therein small-diameter roller (for example, radius of 7 mm) 141, a pair of belt-drive rollers 142 and 143, belt 144 trained about the belt-drive rollers 142 and 143, spring hooking shaft 145, pressure spring 146 that presses belt 144 through the small-diameter roller 141 in the direction opposite to the conveyance path for a sheet, and second correction extent adjusting section 147 that urges the spring hooking shaft 145 in the direction opposite to that of a conveyance path for a sheet to change stress of the pressure spring 146 and adjusts an extent of curl correction for a sheet.

In the curl correcting section 140, when switching gate 148 that switches conveyance paths is at the position shown by one-dot chain lines, correction conveyance path HR41 that does not pass through the curl correcting section 140 is selected, while, when the switching gate 148 is at the position shown by solid lines, correction conveyance path HR42 that passes through the curl correcting section 140 is selected.

Further, the switching gate 148 is turned on or turned off by a control section which will be explained later, depending on a thickness and a type of a sheet and on the direction of a curl.

Since the correction conveyance path HR41 has a large radius of curvature (for example, radius 60 mm) as illustrated, curls are not corrected when sheet S conveyed in the direction of an arrow passes through the correction conveyance path HR41.

In contrast to this, when sheet S passes through correction conveyance path HR42 formed by small-diameter roller 141 and by belt 144, bending force by the small-diameter roller 141 and by the belt 144 is applied on the sheet S, and curls on the sheet S are corrected.

Sheet S having thereon an image formed on the upper surface in entrance 101 and having downward curls (namely, forming a convex form facing downward in entrance 101) is in a posture wherein its image surface faces downward obliquely on the left side, in the curl correcting section 140 (namely, a convex form facing upward obliquely on the right side in curl correcting section 140).

Therefore, the sheet having downward curls, namely, having a convex form facing upward obliquely on the right side receives urging force in the direction opposite to the direction of the convex form by small-diameter roller 141 (namely, bending force caused by small-diameter roller 141 and by belt 144), when the sheet passes through correction conveyance path HR42 along belt 144 and curls are corrected.

As a result, downward curls are corrected to be in a shape of a flat plate.

Further, this urging force can be adjusted by the second correction extent adjusting section 147, and is changed by a control section explained later, depending on a thickness and a type of a sheet.

Figure 4:
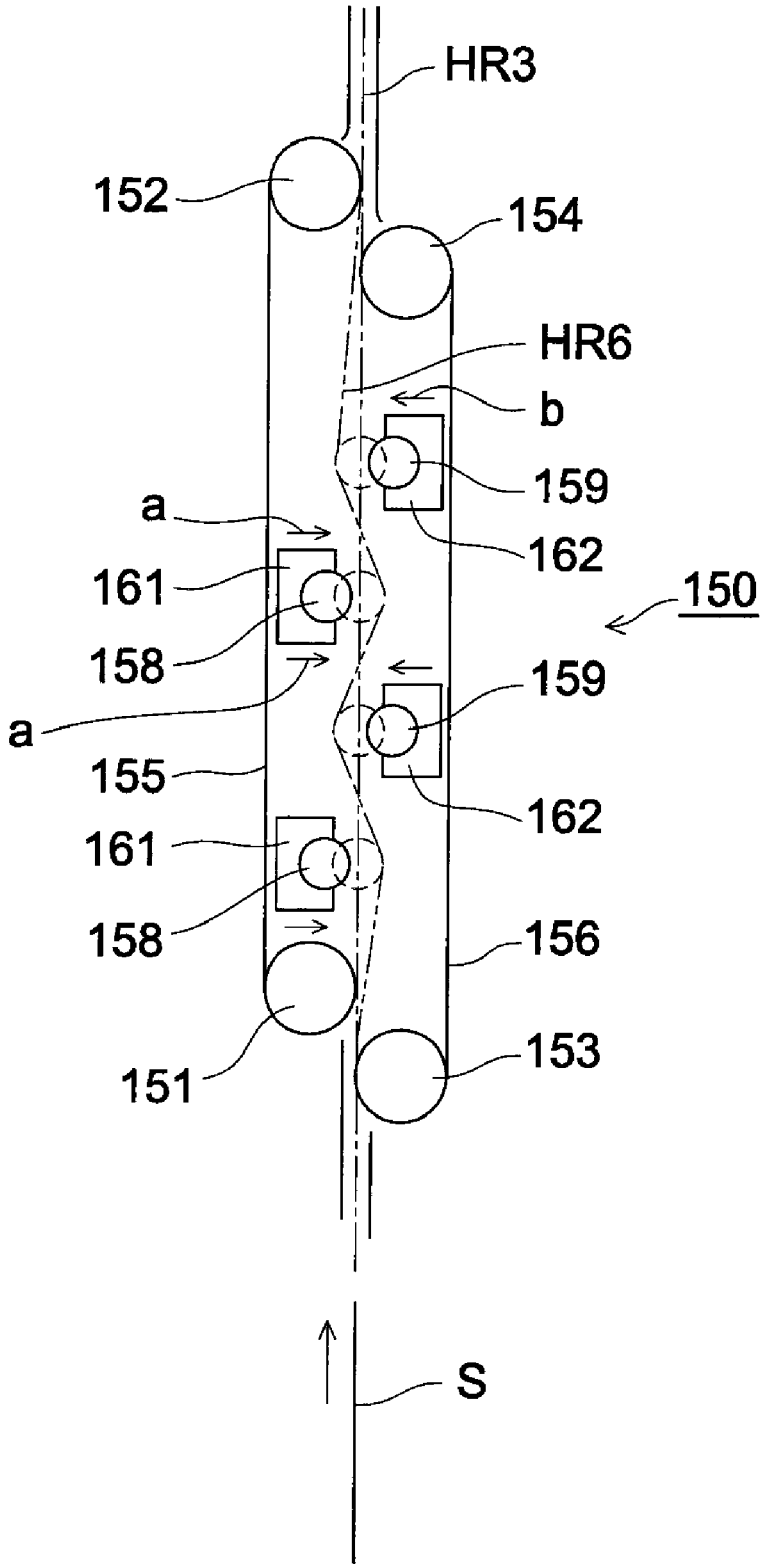
FIG. 4 is an enlarged illustration of curl correcting section 150.

FIG. 4 is an enlarged illustration of curl correcting section 150.

The curl correcting section 150 has therein belt-drive rollers 151 and 152, belt 155 trained about the belt-drive rollers 151 and 152 and belt 156 trained about the belt-drive rollers 153 and 154 and about belt-drive rollers 153 and 154.

Belt 155 and belt 156 are rotatable while they are in contact with each other on the correction conveyance path HR3 side.

Inside the belt 155, there are provided small-diameter rollers 158 which are smaller than belt-drive rollers 151 and 152 movably, and inside the belt 156, there are provided small-diameter rollers 159 which are smaller than belt-drive rollers 153 and 154 movably.

Third correction extent adjusting section 161 that urges small-diameter roller 158 toward opposing belt 156 (direction of arrow a) and adjusts curl correction extent for the sheet is connected to the small-diameter roller 158.

Fourth correction extent adjusting section 162 that urges small-diameter roller 159 toward opposing belt 155 (direction of arrow b) and adjusts curl correction extent for the sheet is connected to the small-diameter roller 159.

Owing to the foregoing, the third correction extent adjusting section 161 urges small-diameter roller 158, and the fourth correction extent adjusting section 162 urges small-diameter roller 159, and when the belt 155 and the belt 156 form a shape of a zigzag (two-dot chain lines zigzag conveyance path HR6), sheet S that is interposed between the belt 155 and the belt 156 to be conveyed receives bending force in both directions alternately, thus, upward curls and downward curls are corrected.

Urging force of the third correction extent adjusting section 161 and that of the fourth correction extent adjusting section 162 are caused to be capable of being adjusted by a control section, and desired urging force in accordance with an extent of curl of a sheet to be conveyed is generated, whereby, a sheet having a curl with optional extent can be made to be in a shape of a flat plate.

Further, when the third correction extent adjusting section 161 does not urge small-diameter roller 158 and the fourth correction extent adjusting section 162 does not urge small-diameter roller 159, and each of belt 155 and belt 156 becomes to be linear (one-dot chain line), sheet S interposed between the belt 155 and the belt 156 to be conveyed does not receive bending force, and curls are not corrected.

Incidentally, when upward curls and downward curls are corrected all the time, it is also possible to fix small-diameter roller 158 and small-diameter roller 159 respectively at positions shown with broken lines, by providing neither the third correction extent adjusting section 161 nor the fourth correction extent adjusting section 162.

Owing to the foregoing, the belt 155 and the belt 156 become to be in a form of zigzag (two-dot chain line-zigzag conveyance path HR6), and sheet S interposed between the belt 155 and the belt 156 to be conveyed receives bending force constantly in both directions alternately, whereby, upward curls and downward curls are corrected constantly.

In addition, it is also possible to increase the number of steps in a form of zigzag by providing a plurality of pairs each including small-diameter roller 158 and small-diameter roller 159, which makes it possible to correct curls gradually, therefore, this method can be used favorably for correcting curls on the sheets which are difficult to be corrected at a time, like the sheets, for example, having great basis weight.

Conveying sheet S nipped by belts while urging it in a zigzag form as stated above makes it possible to correct upward curls and downward curls to be in a shape of a flat plate.

Figure 5:
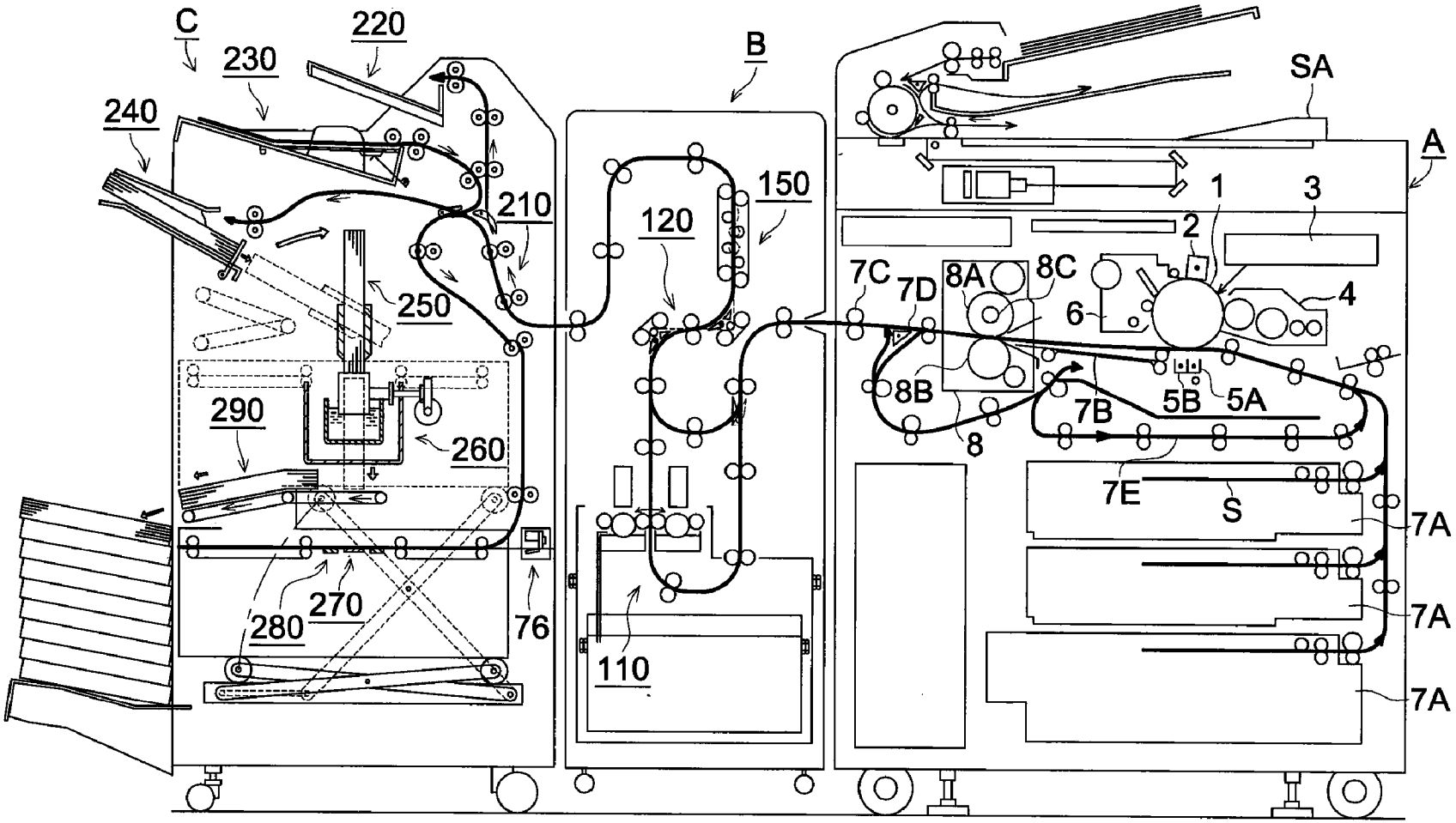
FIG. 5 is an illustration of an image forming system having therein image forming apparatus A, sheet processing apparatus B and sheet finisher C.

FIG. 5 is an illustration of an image forming system having therein image forming apparatus A, sheet processing apparatus B and sheet finisher C.

The image forming apparatus A has an image forming section wherein charging section 2, image-wise exposure section (writing section) 3, developing section 4, transfer section 5A, neutralizing section 5B and cleaning section 6 are arranged around image carrier 1 that rotates.

In the image forming section, the charging section 2 carries out uniform charging on a surface of the image carrier 1, then, exposure scanning based on image data obtained through reading of a document by a laser beam of the image-wise exposure section 3 is conducted to form a latent image after uniform charging is carried out on the surface of the image carrier 1, and a toner image is formed on a surface of the image carrier 1 after the latent image is subjected to reversal development by the developing section 4.

Sheet S fed out of sheet storage section 7A is sent to a transfer position. In the transfer position, the toner image is transferred onto the sheet S by the transfer section 5A.

After that, electric charges on the reverse side of the sheet S are eliminated by the neutralizing section 5B, and the sheet S is separated from the image carrier 1 to be conveyed by conveyance section 7B, and is heated and fixed by fixing section 8 to be ejected from sheet ejection roller 7C.

The fixing section 8 has therein heat roller 8A, pressure roller 8E that comes in pressure contact with the heat roller 8A and heater 8C, and an unfixed toner image is heated by the heat roller 8A that is heated by the heater 8C, thus, toner is fused and the toner image is fixed on the sheet S.

When forming images on both sides of sheet S, the sheet S that has been subjected to heating and fixing by the fixing section 8 is detached from an ordinary sheet ejection path by conveyance path switching plate 7D, then, is caused to switchback in reversing conveyance section 7E to be reversed inside out, and passes through the image forming section again, thus, an image is formed on the reverse side of the sheet S.

Then, the sheet S is ejected to the outside of an apparatus from sheet ejection roller 7C through fixing section 8. The sheet S ejected from the sheet ejection roller 7C is sent to sheet processing apparatus B.

Developing agents still staying on a surface of image carrier 1 even after image processing are removed by cleaning section 6 so that the surface is prepared to be ready for following image forming.

On operation section SA representing a setting section, a curl correction setting screen (FIGS. 7 and 8 described later) that sets correction conditions for curls in sheet processing apparatus B is displayed, and information by an operator such as basis weight of a sheet is set.

Then, information thus set is transmitted to sheet processing apparatus B by an unillustrated communication section.

Meanwhile, in a storage section of image forming apparatus A, information that displays the curl correction setting screen is stored in advance.

Then, information that displays a curl correction setting screen is read out of the storage section as occasion demands, and the curl correction setting screen is displayed on a display screen such as a touch panel provided on operation section SA.

Incidentally, when manufacturing and marketing, for example, image forming apparatus A and sheet processing apparatus B individually, it is also possible to store information to display a curl correction setting screen in sheet processing apparatus B in advance in a storage section of sheet processing apparatus B, and when the image forming apparatus A is connected with the sheet processing apparatus B, to transmit information that displays a curl correction setting screen from sheet processing apparatus B to image forming apparatus A through a communication section of the sheet processing apparatus B and a communication section of the image forming apparatus A, so that the information may be stored in a storage section of the image forming apparatus A.

An explanation of the sheet processing apparatus B will be omitted here, because it has already been given earlier.

Sheet finisher C is composed of sheet conveyance section 210, sheet ejection section 220, cover supplying section 230, sheet bundle storing section 240, sheet bundle conveying section 250, paste coating section 260, cover pasting section 270, cover-folding section 280 and booklet ejecting section 290.

The respective sections are arranged on a tandem placement basis vertically, in a main body of the sheet finisher C.

Sheet S ejected from the sheet processing apparatus B is stored temporarily at the prescribed position of sheet bundle storage section 240 of the sheet finisher C, and is stacked one after another.

A sheet bundle composed of sheets S in the prescribed number is formed in sheet bundle storage section 240, then, the sheet bundle is sent to sheet bundle holding section 250 where paste is coated on a bottom surface of the sheet bundle by paste coating section 260, when the sheet bundle holding section 250 rotates to be almost vertical, thus, a sheet bundle is tied up.

A cover is supplied from cover pasting section 270 to the sheet bundle thus tied up to be put together, and the cover is folded by cover-folding section 280, whereby, a booklet is formed.

The booklet thus formed is ejected out of sheet finisher C by booklet ejecting section 290.

Though the explanation has been given under the condition of a finished image forming system, it is naturally possible to complete an image forming system finally by connecting sheet processing apparatus B to image forming apparatus A later, or by connecting sheet processing apparatus B and sheet finisher C to image forming system some other day.

The foregoing has been an explanation for structures of the image forming apparatus A, the sheet processing apparatus B and the sheet finisher C, and control of the sheet processing apparatus B will be explained as follows.

Figure 6:
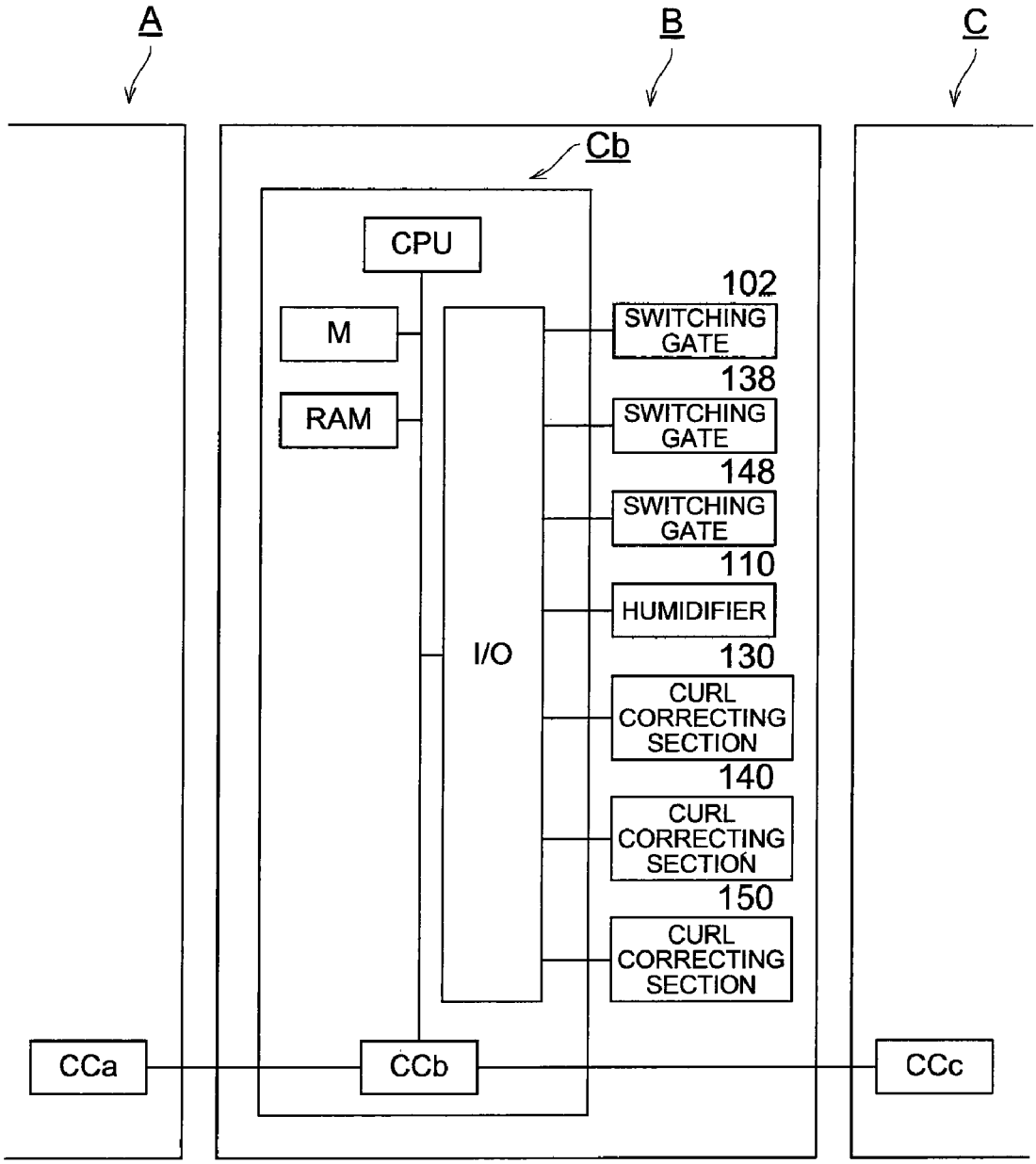
FIG. 6 is a block diagram for the control relating to curl correction of sheet processing apparatus B.

FIG. 6 is a block diagram for the control relating to curl correction of sheet processing apparatus B.

Control section Cb of the sheet processing apparatus B has therein nonvolatile storage section M in which control program for total sheet processing apparatus b is stored in advance, RAM that stores various types of data temporarily, CPU that reads out control programs one after another, and causes RAM to store and to practice, interface unit I/O that conducts interface with various types of input and output members and communication section CCb that communicates with communication section CCa of image forming apparatus A and with communication section CCc of sheet finisher C.

In the nonvolatile storage section M, there are stored programs described in a flow diagram explained later, and information that displays curl correction setting screen that is described later, in advance.

Then, CPU reads out programs described on a flow diagram described later as occasion demands, and practices control relating to curl correction.

Switching gate 102 is controlled by CPU through interface unit I/o to switch a conveyance path for a sheet to humidification conveyance path HR2 or to bypass conveyance path HR5.

Switching gate 138 is controlled by CPU through interface unit I/O to switch a conveyance path for a sheet to correction conveyance path HR31 or to correction conveyance path HR32.

Switching gate 148 is controlled by CPU through interface unit I/O to switch a conveyance path for a sheet to correction conveyance path HR41 or to correction conveyance path HR42.

With respect to humidifying section 110, drive motor (not shown) that drives humidifying roller 111A and humidifying roller 111B and a pump (not shown) are controlled by CPU through interface unit I/O, and a sheet is humidified.

With respect to curl correcting section 130, first correction extent adjusting section 137 is controlled by CPU through interface unit I/O, and urging force to correct upward curls is adjusted.

With respect to curl correcting section 140, second correction extent adjusting section 147 is controlled by CPU through interface unit I/O, and urging force to correct downward curls is adjusted.

With respect to curl correcting section 150, third correction extent adjusting section 161 and fourth correction extent adjusting section 162 are controlled by CPU through interface unit I/O, and urging forces to correct upward and downward curls are adjusted.

Communication section CCb communicates with communication section CCa of image forming apparatus A and with communication section CCc of sheet finisher C, and gives and receives various types of information.

Setting condition information relating to curl correction set by curl correction setting screen P displayed on an operation section (not shown) of image forming apparatus A is transmitted to sheet processing apparatus B through communication section CCa and communication section CCc, to be used for the following flow processing.

Figure 7:
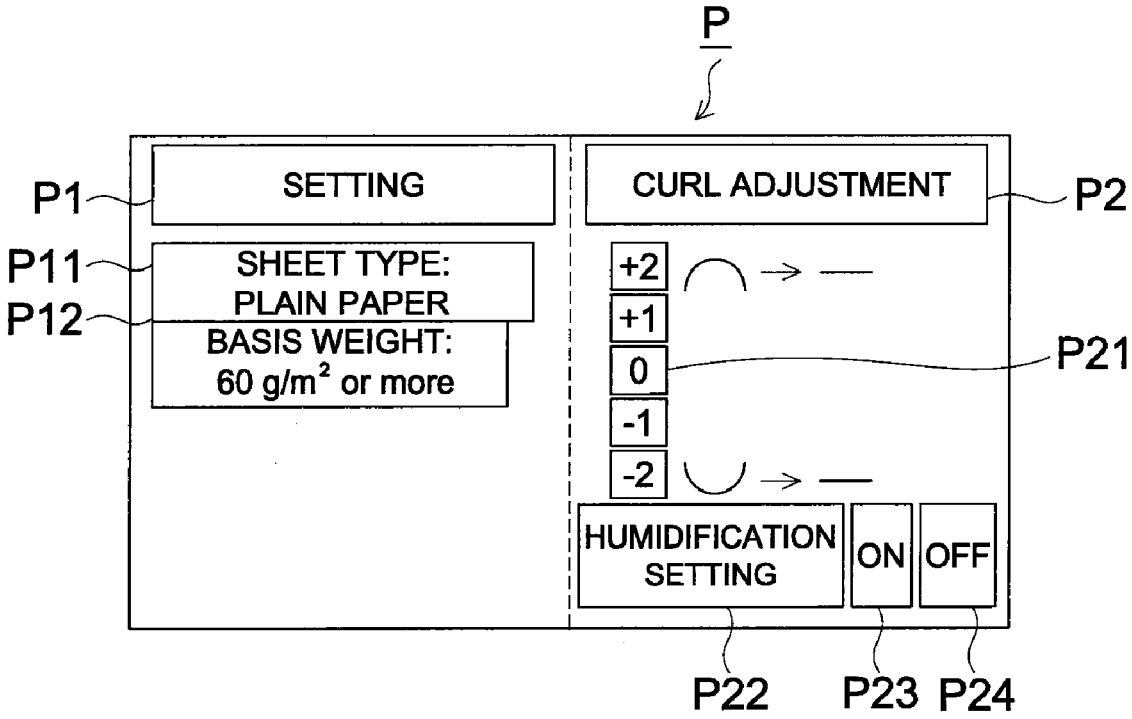
FIG. 7 is an illustration of a curl correction-setting screen.

FIG. 7 is an illustration of a curl correction setting screen.

FIG. 7 is a basic screen of a curl correction setting screen, and it shows a curl correction setting screen on the occasion where plain paper and basis weight 60 g/m$^2$ or more are set respectively by the following sheet type setting section P11 and basis weight setting section P12.

When a prescribed sheet, namely, plain paper and basis weight 60 g/m$^2$ or more are displayed in the case of job setting, and are set on a curl correction setting screen representing a basic screen of a curl correction setting screen, plain paper and basis weight 60 g/m$^2$ or more transmit to curl correction setting screen P representing a curl correction setting screen in the case of setting. However, in this case, contents displayed remain unchanged.

An occasion wherein plain paper and basis weight 60 g/m$^2$ or more are set will be explained as follows.

The curl correction setting screen P is divided into setting section P1 that sets information relating to a sheet and curl adjusting section P2 that sets information relating to curl correction (adjustment).

The setting section P1 is divided into sheet type setting section P11 that sets a sheet type and basis weight setting section P12 that sets basis weight, and in the sheet type setting section P11, sheet types, for example, plain paper and color paper or the like (in the drawing, plain paper is set) are set, and in basis weight setting section P12, basis weight, for example, less than 60 g/m$^2$ (less than 59 g/m$^2$ or less in illustration), 60 g/m$^2$ or more (60 g/m$^2$ or more in illustration) are set.

Curl adjusting section P2 is divided into curl adjustment setting section P21 that sets an extent of curl adjustment and sets whether adjustment of upward curls or adjustment of downward curls and humidification setting section P22 that sets whether conducting humidification or conducting no humidification (ON key P23, OFF key P24).

The curl adjustment setting section P21 has +2 key and +1 key which adjust an extent of upward curl adjustment (namely, adjusting upward curls to be in the direction of a flat plate), and an extent of upward curl adjustment is set by +2 key and +1 key, and has −2 key and −1 key which adjust an extent of downward curl adjustment (namely, adjusting downward curls to be in the direction of a flat plate), and an extent of downward curl adjustment is set by −2 key and −1 key, and adjustments for both upward curls and downward curls are set by 0 key that adjusts both upward curls and downward curls to be in the direction of a flat plate.

Meanwhile, (+1) of curl correction extent (intensity) key Q223 is a key for correcting relatively small upward curls and curls of a sheet having low stiffness, while, (+2) is a key for correcting severe upward curls and curls of a sheet having high stiffness.

Further, (−1) of curl correction extent (intensity) key Q223 is a key for correcting relatively small downward curls and curls of a sheet having low stiffness, while, (−2) is a key for correcting severe downward curls and curls of a sheet having high stiffness.

Further, in humidification setting section P22, right or wrong for practice of humidification is set by selection of ON key P23 or OFF key P24.

Incidentally, when setting neither curl adjustment setting section P21 nor humidification setting section P22, curls are not corrected.

Owing to the foregoing, when a prescribed sheet, namely, basis weight 60 g/m$^2$ or more is set at sheet basis weight setting section P12, setting for curl correction and setting for humidification processing become possible, in accordance with key operations relating to curl correction and humidification processing thereafter.

Figure 8A:
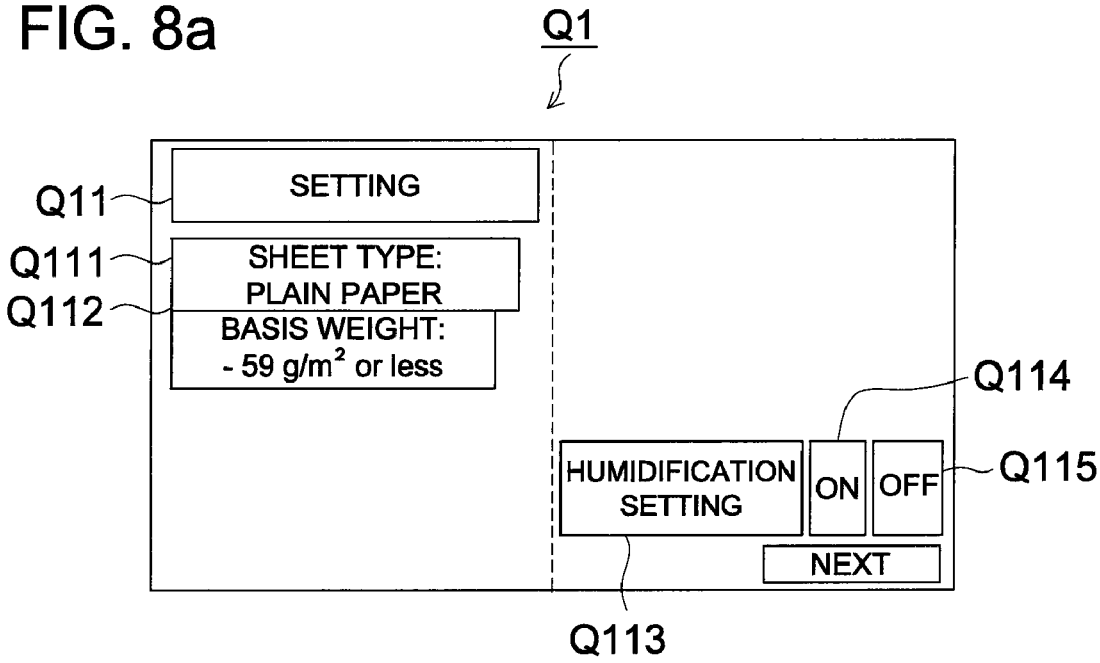
FIGS. 8*a* and 8*b* are illustrations of a curl correction setting screen for thin sheets.
Figure 8B:
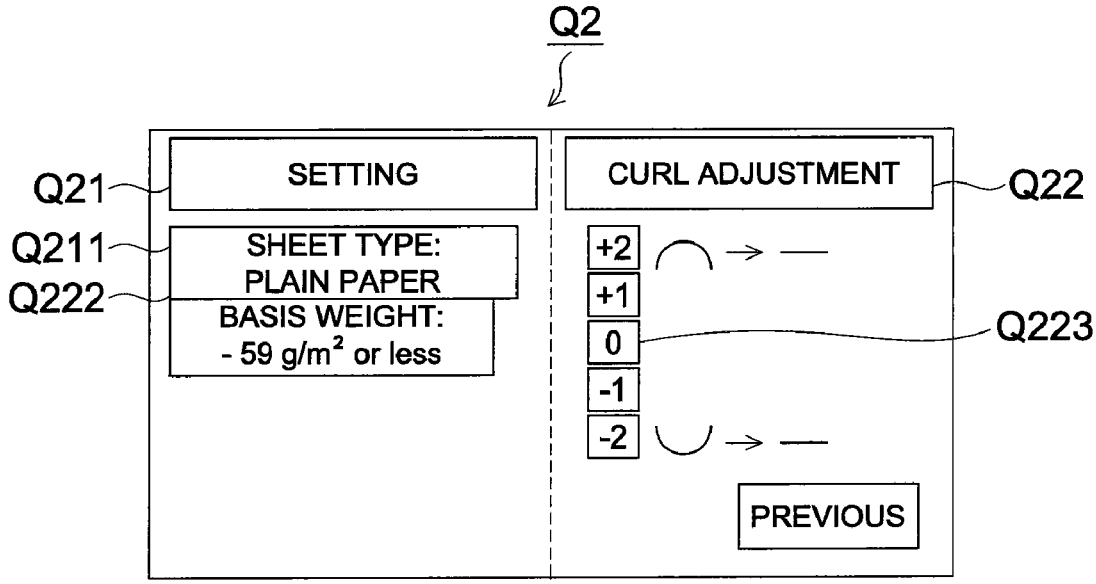

FIGS. 8*a* and 8*b* are illustrations of a curl correction setting screen for a thin sheet.

FIG. 8*a* is a diagram of curl correction setting screen Q1 that is transited when a sheet other than a prescribed sheet, namely, plain paper (P11) having basis weight less than 60 g/m$^2$ (P12) is set, in curl correction setting screen (FIG. 7) representing a basic screen of curl correction setting screen that is displayed in the case of setting a job, or when "PREVIOUS" key is set in the following curl correction setting screen Q2.

FIG. 8*b* is a diagram of curl correction setting screen Q2 that is transited when "NEXT" key is set in the curl correction setting screen Q1.

In FIG. 8*a*, curl correction setting screen Q1 is divided into setting section Q11 that sets information relating to sheets and humidification setting section Q113 (ON key Q114, OFF key Q115) that sets whether conducting humidification or not, and it has a "NEXT" key.

A key relating to humidification processing is displayed as stated above, and setting about humidification processing is made possible, in the same way as that explained by referring to FIG. 7.

Further, by setting the "NEXT" key, it is possible to transit to the following curl correction setting screen Q2.

Further, when humidification setting ON key 0114 is selected in curl correction setting screen Q1, operations of the "NEXT" key are made to be impossible, resulting in an inability to perform curl adjustment processing.

When humidification setting OFF key Q115 is selected, operations of the "NEXT" key are made possible, and curl setting screen Q2 shown in FIG. 8*b* is displayed by operating the "NEXT" key.

Then, setting of curl correction extent (intensity) by curl correction extent (intensity) key Q223 is made possible, and curl adjustment processing is carried out by the setting.

In FIG. 8*b*, curl correction setting screen Q2 is divided into setting section Q21 that sets information relating to sheets and curl adjusting section Q22 that sets curl correction, and it has a "PREVIOUS" key.

Curl correction extent (intensity) keys Q223 (+2-0-−2 keys) are displayed on curl adjusting section Q22, so that setting about curl correction extent (intensity) is made possible, in the same way as that explained by referring to FIG. 7.

Namely, when humidification ON key Q114 of humidification setting section Q113 is selected, humidification processing only is made possible, while, when humidification setting OFF key Q115 is selected, curl correction only is made possible.

Further, by setting the "PREVIOUS" key, it is possible to transit to the previous curl correction setting screen Q1, thus, fresh start for setting is made possible.

When a sheet other than a prescribed sheet in terms of basis weight, namely a sheet having basis weight of less than 60 g/m$^2$ is selected by a basis weight setting key as stated above, it is possible to make setting of curl correction only to be possible, or to make setting of humidification processing only to be possible, depending on key operations relating to curl correction and humidification processing thereafter.

Owing to this, it is possible to practice curl correction only, or humidification processing only.

Meanwhile, in the curl correction setting screen P, curl correction setting screen Q1 and curl correction setting screen Q2 which are displayed on operation section SA of image forming apparatus A, the occasion where neither curl adjustment nor humidification setting is set corresponds to the mode of no processing (processing by sheet processing apparatus B is not conducted), the occasion where curl adjustment is not set and humidification setting only is set corresponds to the mode of humidification (humidification processing only is conducted), the occasion where humidification setting is not set and curl adjustment only is set corresponds to the first curl correction mode (that conducts curl correction only), and the occasion where both of curl adjustment and humidification setting are set corresponds to the second curl correction mode (that conducts humidification and curl correction).

Namely, in the operation section SA of image forming apparatus A, it is possible to set information relating to the job including, for example, a mode without processing, a humidification mode, a first curl correction mode and a second curl correction mode.

Thus, owing to the setting, the sheet processing apparatus B makes the curl correction possible in a mode without processing, a humidification mode, a first curl correction mode or a second curl correction mode.

Further, in the curl correction setting screen P and curl correction setting screen Q2, the occasion where +2 key or +1 out of keys for +2-0-−2 of curl adjustment section is set, corresponds to the mode to conduct the upward curls correction, the occasion where −2 key or −1 key is set, corresponds to the mode to conduct the downward curls correction, and the occasion where 0 key is set, corresponds to the mode to conduct correction of the both (upward and downward) curls.

Namely, in the operation section SA of image forming apparatus A, it is possible to set information relating to the job including, for example, a mode to conduct upward curl correction, a mode to conduct downward curl correction and a mode to conduct both upward and downward curls correction.

Thus, owing to the setting, the sheet processing apparatus B makes the curl correction possible in a mode to conduct upward curl correction, or a mode to conduct downward curl correction, or a mode to conduct both upward and downward curls correction.

Figure 9:
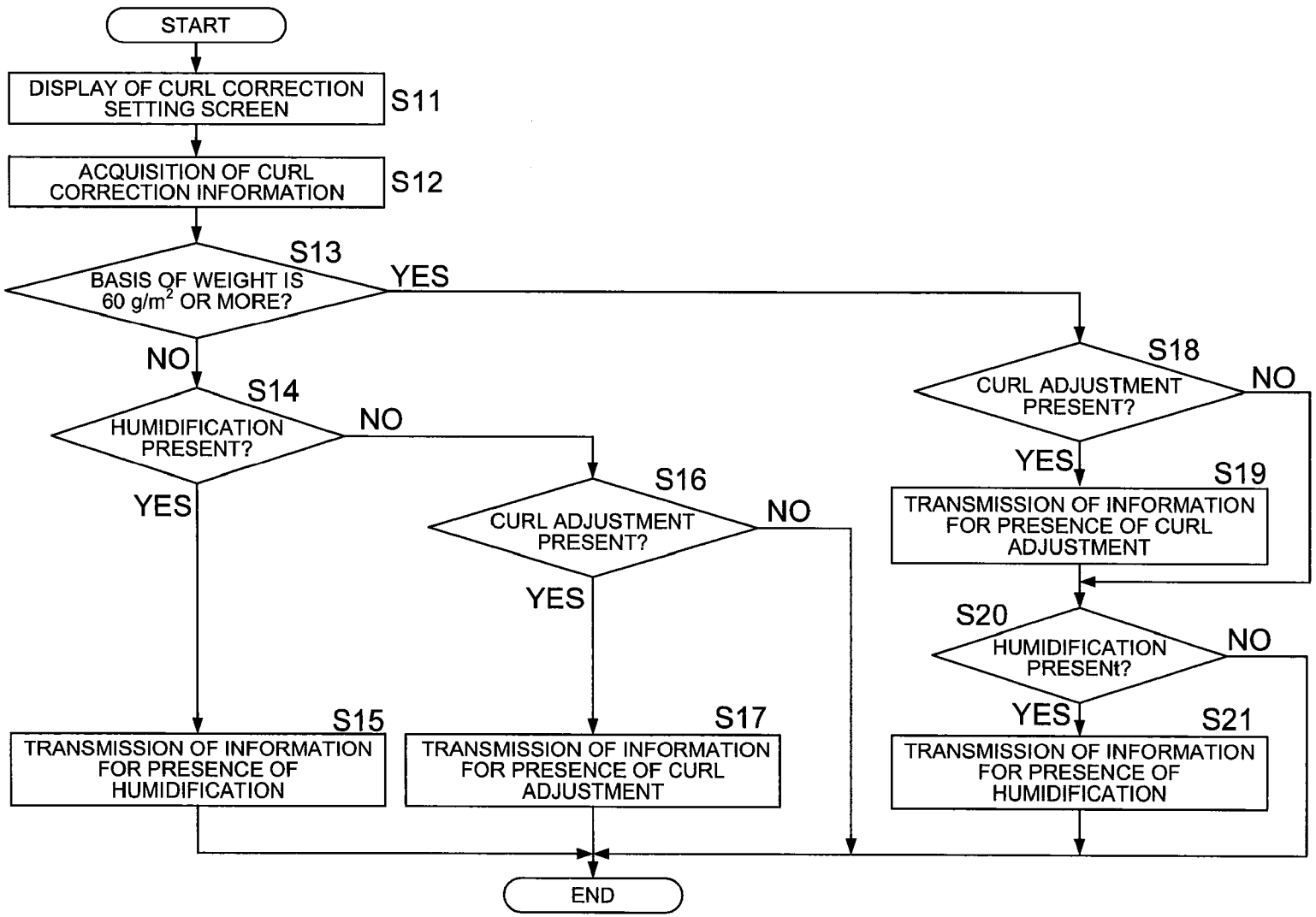
FIG. 9 is a flow chart of the control concerning curl correction of sheets in image forming apparatus A.

FIG. 9 is a flow chart of the control concerning curl correction of sheets in image forming apparatus A.

First, an outline of control flow concerning curl correction for sheets in image forming apparatus A will be explained, referring to FIGS. 9, 6 and 7, before explaining control flow for correcting curls of sheets in sheet processing apparatus B.

1. Display of Curl Correction Setting Screen: Step S11

For example, in setting a job, curl correction setting screen display information that displays a setting screen (curl correction setting screen•FIG. 7) concerning curl correction is read out from a storage section of image forming apparatus A, to cause a display screen such as a touch panel provided on operation section SA to display curl correction setting screen P to advance to the following step.

2. Basis Weight Reading of Basis Weight Setting Section P12: Step S12

An operator sets information concerning basis weight, humidification and curl correction on curl correction setting screen P displayed on a display screen.

Information concerning curl correction including basis weight that is set by basis weight setting section P12 is read to be stored in a storage section such as RAM, to advance to the following step.

3. Judgment for Whether Basis Weight is Not Less than 60 $g/m^2$ or Not: Step S13

A judgment for whether the basis weight thus read is not less than 60 $g/m^2$ or not is made, and when the basis weight is not less than 60 $g/m^2$ (Yes), curl correction setting screen P is caused to be displayed continuously, to advance to step S18, and when the basis weight is less than 60 $g/m^2$ (No), the curl correction/setting screen P is caused to transit to curl correction setting screen Q1, to advance to the following step.

4. Judgment of Presence or Absence of Humidification: Step S14

In curl correction setting screen Q1, when ON key Q114 of humidification setting section Q113 is set (Yes), a flow advances to the following step and when OFF key Q115 of humidification setting section Q113 is set (No), curl correction setting screen Q1 is caused to transit to curl correction setting screen Q2, to advance to step S16.

5. Transmission of Information for Humidification Present: Step S15

Information of humidification present is transmitted to communication section CCb of sheet processing apparatus B through communication section CCa, to advance to END.

6. Judgment for Presence or Absence of Curl Adjustment: Step S16

In curl correction setting screen Q2, when curl adjusting section Q22 is set (Yes), curl correction extent (intensity) key Q223 (+2-0--2 keys) of curl adjusting section Q22 is read, to advance to the following step, and when curl adjusting section Q22 is not set (No), a flow advances to END.

7. Transmission of Information of Curl Adjustment Present: Step S17

Information of curl correction present and information of curl correction extent (+2-0--2) are transmitted to communication section CCb of sheet processing apparatus B through communication section CCa, to advance to END.

8. Judgment for Presence or Absence of Curl Adjustment: Step S18

In curl correction setting screen P (FIG. 7), when curl adjusting section P2 is set (Yes), curl correction extent (intensity) key P21/Q223 (+2-0--2 keys) of curl adjusting section P2 is read, to advance to the following step, and when curl adjusting section P2 is not set, a flow advances to step S20 (No).

9. Transmission of Information of Curl Adjustment Present: Step S19

Information of curl correction present and information of curl correction extent (+2-0--2) are transmitted to communication section CCb of sheet processing apparatus B through communication section CCa, to advance to the following step.

10. Judgment of Presence or Absence of Humidification Step S20

In curl correction setting screen P, when ON key P23 of humidification setting section P22 is set (Yes), a flow advances to the following step, and when OFF key P24 of humidification setting section P22 is set, and a flow advances to END.

11. Transmission of Information of Humidification Present Step S21

Information of humidification present is transmitted to communication section CCb of sheet processing apparatus B through communication section CCa, to advance to END.

Incidentally, when manufacturing and marketing image forming apparatus A and sheet processing apparatus B individually, to systemize by combining both of them later, a flow of control concerning curl correction for sheets in image forming apparatus A may be stored either in the sheet processing apparatus B, or, it may be transmitted to image forming apparatus A by a communication section to be stored in the image forming apparatus A in the case of the combination of the image forming apparatus A and the sheet processing apparatus B.

Step S13 and steps S18-S21 make it possible to set both curl adjustment and humidification in the case of the basis weight of 60 $g/m^2$ or more, namely, in the case of the prescribed sheet, whereby, both curl adjustment and humidification are made possible.

Further, when basis weight is less than 60 $g/m^2$, namely, when a sheet is other than a prescribed sheet, one of curl adjustment and humidification can be set, thereby, one of the curl adjustment and the humidification are made possible.

Figure 10:
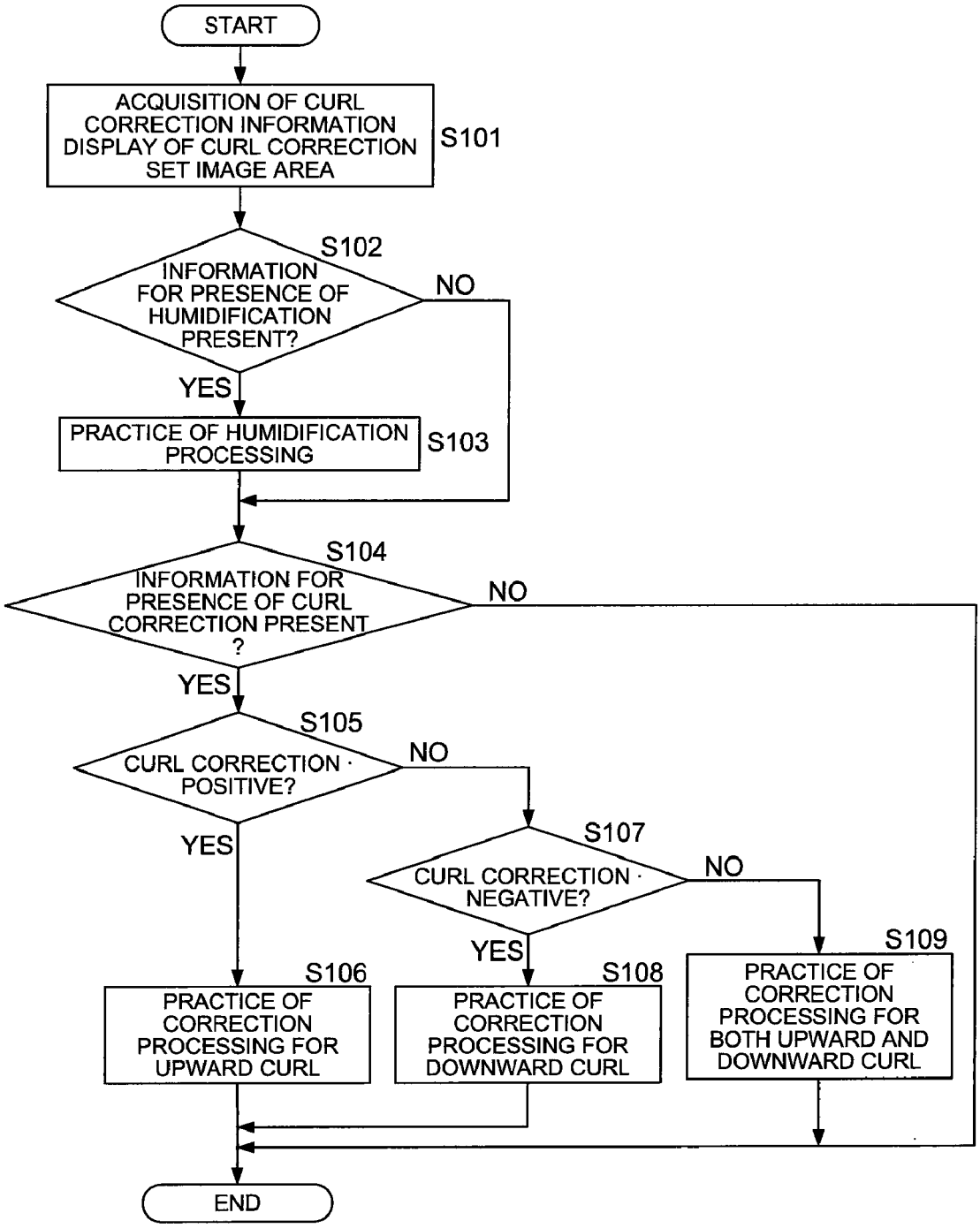
FIG. 10 is a flow chart of the control concerning curl correction of sheets in sheet processing apparatus B.

FIG. 10 is a flow chart of the control concerning curl correction of sheets in sheet processing apparatus B.

A flow for the control to correct curls of sheets will be explained as follows, referring to FIG. 10.

1. Acquisition of Information Concerning Curl Adjustment: Step S101

Image forming apparatus A receives transmitted information concerning curl adjustment, and stores it in RAM and advances to the following step.

Incidentally, information concerning curl adjustment includes information about humidification present transmitted in the step S15, information of curl correction present and curl correction extent information (+2-0--2) transmitted in step S17, information of curl correction present and curl correction extent information (+2-0--2) transmitted in step S19 and information about humidification present transmitted in step S21.

2. Judgment for Information for Presence of Humidification: Step S102

Information concerning curl adjustment received from RAM is read out, and when information for presence of humidification is present (Yes), a flow advances to the following step for conducting humidification processing, and when information for presence of humidification is not present (No), a flow advances to step S104.

3. Practice of Humidification Processing: Step S103

Water is pumped up by a pump (not shown) or the like into water-supply tanks 114A and 114B, then, humidifying rollers 111A and 111B are rotated by a drive motor (not shown) that rotates the humidifying rollers 111A and 111B, thus, a sheet passing through the humidifying rollers is coated with water (humidification), and a flow advances to the following step.

4. Judgment for Information for Presence of Curl Correction: Step S104

Information concerning presence or absence of curl correction received from RAM is read out, and when information for presence of curl correction is present (Yes), a flow advances to the following step for reading out information of curl correction extent, and when information for presence of humidification is not present (No), a flow advances to END.

5. Acquisition of Information Concerning Curl Collection Extent: Step S105

Information concerning curl correction extent (+2-0–2) is read out, and when information of curl correction extent is positive (+2, +1) (Yes), a flow advances to the following step for conducting processing for upward curl correction, and when information of curl correction extent is not positive (No), a flow advances to step S107.

6. Practice of Correction Processing for Upward Curl: Step S106

Switching gate 138 is operated so that a sheet is caused to pass through correction conveyance path HR32. Then, small-diameter roller 131 is caused to urge first correction extent adjusting section 137 with urging force in accordance with curl correction extent information (+2, +1), to advance to END.

When curl correction extent information +1 is set in this case, the small-diameter roller 131 is caused to urge by relatively small urging force, while, when curl correction extent information +2 is set, the small-diameter roller 131 is caused to urge by great urging force.

7. Acquisition of Curl Correction Extent Information: Step S107

Information concerning curl correction extent (+2-0-–2) is read out, and when information of curl correction extent is negative (–2, –1) (Yes), a flow advances to the following step for conducting processing for downward curl correction, and when information of curl correction extent is not negative (No), a flow advances to step S109 for conducting processing of correction for both upward and downward curls.

8. Practice of Correction Processing for Downward Curl: Step S108

Switching gate 148 is operated so that a sheet is caused to pass through correction conveyance path HR42. Then, small-diameter roller 141 is caused to urge second correction extent adjusting section 147 with urging force in accordance with curl correction extent information (–2, –1), to advance to the following step.

When curl correction extent information –1 is set in this case, the small-diameter roller 141 is caused to urge by relatively small urging force, while, when curl correction extent information –2 is set, the small-diameter roller 141 is caused to urge by great urging force.

9. Practice of Correction Processing for Both Upward and Downward Curls: Step S109

Third correction extent adjusting section 161 and fourth correction extent adjusting section 162 are caused to operate so that a sheet is urged by small-diameter rollers 158 and 159 in the direction opposite to the curl direction, and a flow advances to END.

In steps S104-S109, it is possible to correct curls by at least one of the first curl correcting section, the second curl correcting section and the third curl correcting section which were mentioned earlier, depending on a curl correcting method set by an operator. Owing to the foregoing, curls can be corrected by using different mechanical bending forces (step S101 and steps S104-Step109) and humidifications (step S102 and step S103) for different purposes depending on sheet types and basis weights (step S11-step S21). Therefore, it is possible to prevent occurrence of troubles in conveyance, processing and in integration all caused by the curls, resulting in provision of a sheet processing apparatus wherein required maintenance time caused by abnormal processing is shortened and high productivity is realized, and of an image forming system having the sheet processing apparatus.

What is claimed is:

1. An image forming system comprising:

an image forming section which forms an image on a sheet;

a humidifying section which humidifies the sheet;

a curl correcting section which corrects a curl by applying a mechanical bending force to the sheet;

an input section capable of inputting information relating to the sheet, setting whether or not the humidifying section humidifies the sheet, and setting whether or not the curl correcting section applies the curl correction to the sheet; and a control section which controls the humidifying section, the curl correcting section, and the input section, wherein the control section is configured to (i) determine whether the sheet meets a predetermined condition based upon the input information relating to the sheet, (ii) control the input section to be capable of setting both the humidifying section to humidify the sheet and the curl correction section to apply the curl correction to the sheet in response to the sheet meeting the predetermined condition, (iii) control the input section to only be capable of setting one of the humidifying section to humidify the sheet and the curl correcting section to apply the curl correction to the sheet in response to the sheet not meeting the predetermined condition, and (iv) control at least one of the humidifying section and the curl correcting section to perform at least one of the humidification and the curl correction based on the setting input by the input section.

2. The image forming system as claimed in claim 1, wherein the input section comprises an operation section which is operable by an operator to input the information relating to the sheet, set whether or not the humidifying section humidifies the sheet, and set whether or not the curl correcting section applies the curl correction to the sheet, and wherein the control section is configured to control the operation section to be operable to set both the humidifying section to humidify the sheet and the curl correction section to apply the curl correction to the sheet in response to the sheet meeting the predetermined condition, and to control the operation section to only be operable to set one of the humidifying section to humidify the sheet and the curl correcting section to apply the curl correction to the sheet in response to the sheet not meeting the predetermined condition.

3. The image forming system as claimed in claim 1, wherein the information relating to the sheet includes a basis weight of the sheet, and the control section is configured to control the input section to be capable of setting both the humidifying section to humidify the sheet and the curl correction section to apply the curl correction to the sheet in response to the basis weight of the sheet being at least a predetermined value, and to control the input section to only be capable of setting one of the humidifying section to humidify the sheet and the curl correcting section to apply the curl correction to the sheet in response to the basis weight of the sheet being less than the predetermined value.

4. The image forming system as claimed in claim 1, wherein the information relating to the sheet includes a sheet type, and the control section is configured to control the input section to be capable of setting both the humidifying section to humidify the sheet and the curl correction section to apply the curl correction to the sheet in response to the sheet being a predetermined type, and to control the input section to only be capable of setting one of the humidifying section to humidify the sheet and the curl correcting section to apply the curl correction to the sheet in response to the sheet being other than the predetermined type.

5. The image forming system as claimed in claim 1, wherein the curl correcting section includes a first curl correcting section, a second curl correcting section, and a third curl correcting section, wherein the first curl correcting section applies a mechanical bending force to the sheet from a first surface of the sheet in a direction opposite to an upward curl of the first surface, wherein the second curl correcting section applies a mechanical bending force to the sheet from a second surface of the sheet in a direction opposite to a downward curl of the first surface, wherein the third curl correcting section applies a mechanical bending force to the sheet in a direction opposite to an upward curl of the first surface of the sheet and a downward curl of the first surface of the sheet from the first surface and from a second surface of the sheet, alternately, and wherein in a case in which the curl correction section is set to apply the curl correction, the control section controls at least one of the first curl correcting section, the second curl correcting section, and the third curl correcting section to perform the curl correction based on a setting of the curl correction input by the input section.

6. The image forming system as claimed in claim 5, wherein the upward curl of the sheet is convex with respect to the first surface of the sheet on which an image is formed, and the downward curl of the sheet is concave with respect to the first surface on which the image is formed.

7. The image forming system as claimed in claim 5, wherein the first curl correcting section, the second curl correcting section, and the third curl correcting section respectively include a first adjusting section, a second adjusting section, and a third adjusting section, and wherein the control section is configured to control the first adjusting section to adjust an extent of curl correction by the first curl correcting section, to control the second adjusting section to adjust an extent of curl correction by the second curl correcting section, and to control the third adjusting section to adjust an extent of curl correction by the third curl correcting section.

8. The image forming system as claimed in claim 1, wherein the curl correcting section is disposed downstream of the humidifying section in a sheet conveyance direction.

9. An image forming apparatus that is connectable to a sheet processing apparatus in which at least one of humidification and curl correction is performed on a sheet, the image forming apparatus comprising:

an operation section which is operable to set information relating to a sheet, set whether or not the humidifying section humidifies the sheet, and set whether or not the curl correcting section applies the curl correction to the sheet; and a control section that controls the operation section;

wherein the control section is configured to (i) determine whether the sheet meets a predetermined condition based on the set information relating to the sheet, (ii) control the operation section to be operable to set both the humidifying section to humidify the sheet and the curl correction section to apply the curl correction to the sheet in response to the sheet meeting the predetermined condition, (iii) control the operation section to only be operable to set one of the humidifying section to humidify the sheet and the curl correcting section to apply the curl correction to the sheet in response to the sheet not meeting the predetermined condition.

10. The image forming apparatus as claimed in claim 9, wherein the information relating to the sheet includes a basis weight of the sheet, and the control section is configured to control the operation section to be operable to set both the humidifying section to humidify the sheet and the curl correction section to apply the curl correction to the sheet in response to the basis weight of the sheet being at least a predetermined value, and to control the operation section to only be operable to set one of the humidifying section to humidify the sheet and the curl correcting section to apply the curl correction to the sheet in response to the basis weight of the sheet being less than the predetermined value.

11. The image forming apparatus as claimed in claim 9, wherein the information relating to the sheet includes a sheet type, and the control section is configured to control the operation section to be operable to set both the humidifying section to humidify the sheet and the curl correction section to apply the curl correction to the sheet in response to the sheet being a predetermined type, and to control the operation section to only be operable to set one of the humidifying section to humidify the sheet and the curl correcting section to apply the curl correction to the sheet in response to the sheet being other than the predetermined type.

12. A sheet processing apparatus that is connectable to an image forming apparatus, the sheet processing apparatus comprising:

a humidifying section which humidifies a sheet;

a curl correcting section which corrects a curl by applying mechanical bending force to the sheet;

a storage section which stores a control flow for enabling setting whether or not the humidifying section humidifies the sheet and setting whether or not the curl correcting section applies the curl correction to the sheet, said control flow being configured to cause the image forming apparatus to (i) determine whether the sheet meets a predetermined condition based upon input information relating to the sheet inputted by an input section of the image forming apparatus, (ii) control the input section to be capable of setting both the humidifying section to humidify the sheet and the curl correction section to apply the curl correction to the sheet in response to the sheet meeting the predetermined condition, and (iii) control the input section to only be capable of setting one of the humidifying section to humidify the sheet and the curl correcting section to apply the curl correction to the sheet in response to the sheet not meeting the predetermined condition; and a control section which controls the humidifying section, the curl correcting section, and the storage section;

wherein the control section is configured to (i) read the control flow from the storage section and transmit the control flow to the image forming apparatus when the sheet processing apparatus is connected to the image forming apparatus, (ii) receive from the image forming apparatus the setting for the humidifying section and the curl correcting section from the image forming apparatus, which is set in accordance with the control flow according to the condition of the sheet, (iii) control the humidifying section and the curl correcting section to perform the humidification and the curl correction on a sheet which meets a predetermined condition, based on the received setting, and (iv) control the humidifying section and the curl correcting section to perform only one of the humidification and the curl correction on a sheet which does not meet the predetermined condition, based on the received setting.

13. The sheet processing apparatus as claimed in claim 12, wherein the predetermined condition of the sheet includes a basis weight of the sheet, and the control section is configured to control the humidifying section and the curl correcting section to perform the humidification and the curl correction on a sheet which has a basis weight that is at least a predetermined value, and to control the humidifying section and the curl correcting section to perform only one of the humidification and the curl correction on a sheet which has a basis weight that is less than the predetermined value.

14. The sheet processing apparatus as claimed in claim 12, wherein the predetermined condition of the sheet includes a sheet type, and the control section is configured to control the humidifying section and the curl correcting section to perform the humidification and the curl correction on a sheet of a predetermined type, and to control the humidifying section and the curl correcting section to perform only one of the humidification and the curl correction on a sheet of a type other than the predetermined type.

15. The sheet processing apparatus as claimed in claim 12, wherein the curl correcting section includes a first curl correcting section, a second curl correcting section, and a third curl correcting section, wherein the first curl correcting section applies a mechanical bending force to the sheet from a first surface of the sheet in a direction opposite to an upward curl of the first surface, wherein the second curl correcting section applies a mechanical bending force to the sheet from a second surface of the sheet in a direction opposite to a downward curl of the first surface, wherein the third curl correcting section applies a mechanical bending force to the sheet in a direction opposite to an upward curl of the first surface of the sheet and a downward curl of the first surface of the sheet from the first surface and from a second surface of the sheet, alternately, and wherein in a case in which the curl correction section is set to apply the curl correction, the control section controls at least one of the first curl correcting section, the second curl correcting section, and the third curl correcting section to perform the curl correction based on a setting of the curl correction input by the input section.

16. The sheet processing apparatus as claimed in claim 15, wherein the upward curl of the sheet is convex with respect to the first surface of the sheet on which an image is formed, and the downward curl of the sheet is concave with respect to the first surface on which the image is formed.

17. The sheet processing apparatus as claimed in claim 15, wherein the first curl correcting section, the second curl correcting section, and the third curl correcting section respectively include a first adjusting section, a second adjusting section, and a third adjusting section, and wherein the control section is configured to control the first adjusting section to adjust an extent of curl correction by the first curl correcting section, to control the second adjusting section to adjust an extent of curl correction by the second curl correcting section, and to control the third adjusting section to adjust an extent of curl correction by the third curl correcting section.

18. The sheet processing apparatus as claimed in claim 12, wherein the curl correcting section is disposed downstream of the humidifying section in a sheet conveyance direction.

19. The sheet processing apparatus as claimed in claim 12, further comprising:

a conveyance section that conveys the sheet selectively to the humidifying section and the curl correcting section, wherein the control section is configured to control the conveyance section to convey the sheet which meets the predetermined condition toward the humidifying section and the curl correcting section, and to control the conveyance section to convey the sheet which does not meet the predetermined condition toward (i) the curl correcting section only or (ii) both the humidifying section and the curl correcting section.

* * * * *